US007972386B2

(12) United States Patent
de Almeida et al.

(10) Patent No.: US 7,972,386 B2
(45) Date of Patent: Jul. 5, 2011

(54) BLEACHING OF SUBSTRATES

(75) Inventors: Joaquim Manuel Henriques de Almeida, Matlock (GB); Zinaida Ponie Djodikromo, Rotterdam (NL); Ronald Hage, Vlaardingen (NL)

(73) Assignee: Conopco, Inc., Englewood Cliffs, NJ (US)

( * ) Notice: Subject to any disclaimer, the term of this patent is extended or adjusted under 35 U.S.C. 154(b) by 501 days.

(21) Appl. No.: 12/083,456

(22) PCT Filed: Oct. 4, 2006

(86) PCT No.: PCT/EP2006/009610

§ 371 (c)(1),
(2), (4) Date: Apr. 10, 2008

(87) PCT Pub. No.: WO2007/042192

PCT Pub. Date: Apr. 19, 2007

(65) Prior Publication Data

US 2009/0126121 A1 May 21, 2009

(30) Foreign Application Priority Data

Oct. 12, 2005 (EP) ..... 05256345

(51) Int. Cl.

| | |
|---|---|
| ***D06L 3/02*** | (2006.01) |
| ***C11D 3/26*** | (2006.01) |
| ***C11D 3/39*** | (2006.01) |
| ***C11D 3/395*** | (2006.01) |

(52) U.S. Cl. ..... 8/111; 510/303; 510/311; 510/336; 510/337; 510/372; 510/376; 510/499; 510/505; 510/509

(58) Field of Classification Search ..... 510/303, 510/311, 336, 337, 372, 376, 499, 505, 509; 8/111, 137; 252/186.27, 186.33
See application file for complete search history.

(56) References Cited

U.S. PATENT DOCUMENTS

| | | | | |
|---|---|---|---|---|
| 5,329,024 | A | 7/1994 | Jureller et al. | 549/531 |
| 5,356,554 | A | 10/1994 | Delwel et al. | |
| 5,429,769 | A * | 7/1995 | Nicholson et al. | 510/376 |
| 5,516,738 | A | 5/1996 | Jureller et al. | 502/155 |
| 6,087,312 | A * | 7/2000 | Masotti et al. | 510/309 |
| 2001/0025695 | A1 | 10/2001 | Patt et al. | 162/72 |
| 2002/0010120 | A1 | 1/2002 | Hage et al. | 510/302 |
| 2002/0066542 | A1 | 6/2002 | Jakob et al. | |
| 2003/0040459 | A1 | 2/2003 | Araya et al. | |
| 2005/0137105 | A1 | 6/2005 | Griese et al. | |
| 2005/0137118 | A1 | 6/2005 | Silveri | |

FOREIGN PATENT DOCUMENTS

| | | |
|---|---|---|
| EP | 0458398 | 5/1991 |
| EP | 458 397 | 11/1991 |
| EP | 0509878 | 4/1992 |
| EP | 0530870 | 7/1992 |
| EP | 0544490 | 11/1992 |
| WO | WO 95/27773 | 10/1995 |
| WO | WO 97/44520 | 11/1997 |
| WO | 01/64993 | 9/2001 |
| WO | WO 02/064721 | 8/2002 |
| WO | 02/088063 | 11/2002 |
| WO | WO 2006/125517 | 11/2006 |

OTHER PUBLICATIONS

PCT International Search Report in a PCT application PCT/EP2006/009610, (Aug. 2007).
EP Search Report in EP Application No. EP 05 25 3295.
Hage et al., "Efficient Manganese Catalysts for Low-Temparature Bleaching", Nature, Jun. 23, 1994, vol. 369, pp. 637-639.

* cited by examiner

*Primary Examiner* — Gregory R Del Cotto
(74) *Attorney, Agent, or Firm* — Knobbe, Martens, Olson & Bear, LLP

(57) ABSTRACT

The present invention concerns bleaching of substrates with an aqueous solution of a water soluble salt of a preformed transition metal catalyst together with hydrogen peroxide.

13 Claims, No Drawings

BLEACHING OF SUBSTRATES

FIELD OF INVENTION

The present invention relates to the catalytic bleaching of industrial substrates.

BACKGROUND OF INVENTION

The bleaching of raw cotton and wood pulp are massive industries.

Raw cotton originating from cotton seeds contains mainly colourless cellulose, but has a yellow-brownish colour due to the natural pigment in the plant. Many impurities adhere, especially to the surface. They consist mainly of protein, pectin, ash and wax.

The cotton and textile industries recognise a need for bleaching cotton prior to its use in textiles and other areas. The object of bleaching such cotton fibres are to remove natural and adventitious impurities with the concurrent production of substantially whiter material.

There have been two major types of bleach used in the cotton industry. One type is a dilute alkali or alkaline earth metal hypochlorite solution. The most common types of such hypochlorite solutions are sodium hypochlorite and calcium hypochlorite. Additionally, chlorine dioxide as bleaching agent has been developed and shows less cotton damage than hypochlorite does. Also mixtures of chlorine dioxide and hypochlorite can be applied. The second type of bleach is a peroxide solution, e.g., hydrogen peroxide solutions. This bleaching process is typically applied at high temperatures, i.e. 80 to 100° C. Controlling the peroxide decomposition due to trace metals is key to successfully apply hydrogen peroxide. Often Mg-silicates or sequestering agents such as EDTA or analogous phosphonates can be applied to reduce decomposition.

The above types of bleaching solutions and caustic scouring solutions may cause tendering of the cotton fibre due to oxidation which occurs in the presence of hot alkali or from the uncontrolled action of hypochlorite solutions during the bleaching process. Also hydrogen peroxide is known to give reduced cotton fibre strengths, especially when applied without proper sequestration or stabilisation of transition-metal ions. Tendering can also occur during acid scours by the attack of the acid on the cotton fibre with the formation of hydrocellulose.

Purified cellulose for rayon production usually comes from specially processed wood pulp. It is sometimes referred to as "dissolving cellulose" or "dissolving pulp" to distinguish it from lower grade pulps used for papermaking and other purposes. Dissolving cellulose is characterized by a high cellulose content, i.e., it is composed of long-chain molecules, relatively free from lignin and hemicelluloses, or other short-chain carbohydrates. A manufactured fibre composed of regenerated cellulose, in which substituents have replaced not more than 15% of the hydrogens of the hydroxyl groups.

Wood pulp produced for paper manufacture either contains most of the originally present lignin and is then called mechanical pulp or it has been chiefly delignified, as in chemical pulp. Mechanical pulp is used for e.g. newsprint and is often more yellow than paper produced from chemical pulp (such as for copy paper or book-print paper). Further, paper produced from mechanical pulp is prone to yellowing due to light- or temperature-induced oxidation. Whilst for mechanical pulp production mild bleaching processes are applied, to produce chemical pulp having a high whiteness, various bleaching and delignification processes are applied. Widely applied bleaches include elemental chlorine, chlorine dioxide, hydrogen peroxide, and ozone.

Whilst for both textile bleaching and wood pulp bleaching, chlorine-based bleaches are most effective, there is a need to apply oxygen-based bleaches for environmental reasons. Hydrogen peroxide is a good bleaching agent, however, it needs to be applied at high temperatures and long reaction times. For industry it is desirable to be able to apply hydrogen peroxide at lower temperatures and shorter reaction times than in current processes.

The macrocyclic triazacyclic molecules have been known for several decades, and their complexation chemistry with a large variety of metal ions has been studied thoroughly. The azacyclic molecules often lead to complexes with enhanced thermodynamic and kinetic stability with respect to metal ion dissociation, compared to their open-chain analogues.

EP 0458397 discloses the use manganese 1,4,7-Trimethyl-1,4,7-triazacyclononane (Me3-TACN) complexes as bleaching and oxidation catalysts and use for paper/pulp bleaching and textile bleaching processes. 1,4,7-Trimethyl-1,4,7-triazacyclononane (Me3-TACN) has been used in dishwashing for automatic dishwashers, SUN™, and has also been used in a laundry detergent composition, OMO Power™. The ligand (Me3-TACN) is used in the form of its manganese transition metal complex, the complex having a counter ion that prevents deliquescence of the complex.

United States Application 2001/0025695A1, Patt et al, discloses the use of $PF_6^-$ salts of 1,2,-bis-(4,7,-dimethyl-1,4,7,-triazacyclonon-1-yl)-ethane and $Me_3$-TACN (Me-4-DTNE).

U.S. Pat. Nos. 5,516,738 and 5,329,024, Jureller et al, discloses the use of perchlorate salts of manganese $Me_3$-TACN for epoxidizing olefins. U.S. Pat. No. 5,516,738 also discloses the use of the free $Me_3$-TACN ligand together with manganese chloride in epoxidizing olefins.

WO 2000/088063, to Lonza A G, discloses a process for the production of ketones using $PF_6^-$ salts of manganese $Me_3$-TACN.

United States Application 2002/010120 discloses the bleaching of substrates in an aqueous medium, the aqueous medium comprising a transition metal catalyst and hydrogen peroxide.

SUMMARY OF INVENTION

In one aspect of the present invention there is provided a method for industrial bleaching of a substrate, the method comprising subjecting the substrate in an aqueous medium, the aqueous medium comprising:

from 0.1 to 100 micromolar of a preformed transition metal catalyst; and from 0.01 to 10 g/l of an aminocarboxylate sequestrant or alkali/alkaline metal salt thereof; and, from 5 to 1500 mM hydrogen peroxide, wherein the aqueous medium is buffered with a buffer selected from the group consisting a carbonate buffer having a pH in the range from 7.5 to 9.5 and a borate buffer having a pH in the range from 9 to 10.3 and wherein the preformed transition metal catalyst salt is a mononuclear or dinuclear complex of a Mn II-V transition metal catalyst, the ligand of the transition metal catalyst of formula (I):

(I)

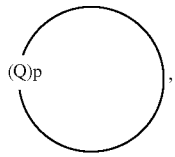

wherein:

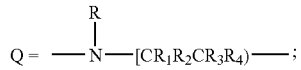

p is 3;

R is independently selected from: hydrogen, C1-C6-alkyl, C2OH, C1COOH, and pyridin-2-ylmethyl or one of R is linked to the N of another Q via an ethylene bridge;

R1, R2, R3, and R4 are independently selected from: H, C1-C4-alkyl, and C1-C4-alkylhydroxy.

The term C2OH is one where —C2-alkyl-OH is such that the C2-alkyl may carry other groups. It is preferred that the C2-alkyl is unsubstituted, i.e., it carries only hydrogen atoms The term C1COOH is one where —C1-alkyl-COOH is such that the C1-alkyl may carry other groups. It is preferred that the C1-alkyl is unsubstituted, i.e., it carries only hydrogen atoms.

The present invention extends to a product treated with the method of the present invention.

DESCRIPTION OF THE INVENTION

The method is particularly applicable to bleaching cotton, wood pulp, wool, rayon, and other protein and cellulose materials. Particular utility is found when cotton is employed as the substrate. The present invention is applicable to a batch or continuous process. In a batch process, material is placed in the vessel at the start and removed at the end of the process. In a continuous process, material flows into and out of the process during the duration of the process.

Optimum Method Conditions

The method comprises various conditions that have been optimized in order to provide the advantages of the present invention. Detailed below are preferred aspects of the methods integers that provide good bleaching while maintaining acceptable integrity of the substrate. The liquor to substrate ratio is preferably in the range from 50/1 to 0.8/1 and depends on whether the method is a batch or continuous process.

Hydrogen Peroxide

Hydrogen peroxide can be added as a liquid (typically 50% in water), or as peroxy salts, such as perborate monohydrate, perborate tetrahydrate, percarbonate, perphosphate, etc. For cost reasons liquid hydrogen peroxide is preferred.

The preferred concentration of hydrogen peroxide depends on whether the method is a batch or continuous process. The reason for this variance is because the liquor to substrate ratio varies dependent upon the process. In a batch process the liquor to substrate ratio is higher, e.g. 10:1, than in a continuous process, e.g. 1:1.

In a batch process the preferred concentration of hydrogen peroxide is in the range from 5 to 150 mM.

In a continuous process the preferred concentration of hydrogen peroxide is in the range from 100 mM to 1.5 M, a most preferred range is from 100 mM to 1 M.

Sequestrant

The sequestrant used in the bleaching step is a aminocarboxylate sequestrant or mixtures thereof. The following are preferred examples of aminocarboxylate sequetrants: ethylenediaminetetraacetic acid (EDTA), N-hydroxyethylenediaminetetraacetic acid (HEDTA), nitrilotriacetic acid (NTA), N-hydroxyethylaminodiacetic acid, diethylenetriaminepentaacetic acid (DTPA), methylglycinediacetic acid (MGDA), and alanine-N,N-diacetic acid. A most preferred aminocarboxylate sequestrant is diethylenetriaminepentaacetic acid (DTPA).

The most preferred concentration of the aminocarboxylate sequestrant used in the method is 0.05 to 5 g/l, most preferably 0.1 to 2 g/l.

Buffer

During the bleaching process the aqueous solution is buffered. The buffer is either a carbonate or a borate buffer. The most preferred pH range for a carbonate buffer is between 8.0 and 9.0. The preferred level of carbonate is from 0.3 to 8 g/l. The most preferred pH range for borate buffer is between 9.3 and 10.0. The preferred level of borate is from 0.5 to 5 g/l, with from 1 to 3 g/l being most preferred. In some instances perborate or percarbonate may contribute to the buffer system.

Transition Metal Catalyst

EP 0458397 discloses the use manganese 1,4,7-Trimethyl-1,4,7-triazacyclononane (Me3-TACN) complexes as bleaching and oxidation catalysts and use for paper/pulp bleaching and textile bleaching processes. 1,4,7-Trimethyl-1,4,7-triazacyclononane (Me3-TACN) has been used in dishwashing for automatic dishwashers, SUN™, and has also been used in a laundry detergent composition, OMO Power™. The ligand (Me3-TACN) is used in the form of its manganese transition metal complex, the complex having a counter ion that prevents deliquescence of the complex. The counter ion for the commercialised products containing manganese $Me_3$-TACN is $PF_6^-$. The is $Me_3$-TACN $PF_6^-$ salt has a water solubility of 10.8 g per litre at 20° C. Additionally, the perchlorate ($ClO_4^-$) counter ion is acceptable from this point of view because of its ability to provide a manganese Me3-TACN that does not appreciably absorb water. However, due to potential explosive properties of transition-metal perchlorate complexes, perchlorate-containing compounds are not preferred. Reference is made to U.S. Pat. No. 5,256,779 and EP 458397, both of which are in the name of Unilever. One advantage of the $PF_6^-$ or $ClO_4^-$ counter ions for the manganese $Me_3$-TACN complex is that the complex may be easily purified by crystallisation and recrystallisation from water. In addition, there non-deliquescent salts permit processing, e.g., milling of the crystals, and storage of a product containing the manganese $Me_3$-TACN. Further, these anions provide for storage-stable metal complexes. For ease of synthesis of manganese $Me_3$-TACN highly deliquescent water soluble counter ions are used, but these counter ions are replaced with non-deliquescent, much less water soluble counter ions at the end of the synthesis. During this exchange of counter ion and purification by crystallisation loss of product results. A drawback of using $PF_6^-$ as a counterion is its significant higher cost when compared to other highly soluble anions.

Whilst the manganese transition metal catalyst used may be non-deliquescent by using counter ions such as $PF_6^-$ or $ClO_4^-$, it is preferred for industrial substrates that the transition metal complex is water soluble. It is preferred that the preformed transition metal is in the form of a salt such that it has a water solubility of at least 50 g/l at 20° C. Preferred salts are those of chloride, acetate, sulphate, and nitrate.

The most preferred concentration of the preformed transition metal catalyst used in the method is from 0.3 to 50 micro molar. The preformed transition metal catalyst may be added in one batch, multiple additions, or as a continuous flow. The use of a continuous flow is particularly applicable to continuous processes.

Surfactant

It is preferred that bleaching method, in particular used for the cotton treatment, is conducted in the presence of a surfactant. The use of surfactants, for example, helps to remove the waxy materials encountered in cotton. For substrates originating from wood pulp, hydrophobic substrates are not encountered and therefore, the need of surfactants in the treatment process is not so preferred. In this regard, it is preferred that a surfactant is present in the range from 0.1 to 20 g/L, preferably 0.5 to 10 g/l. It is preferred that the surfactant is a non-ionic surfactant and most preferably biodegradable.

Pretreatment

The pretreatment step is not essential depending upon the condition of the substrate to be bleached. Depending on the quality of, for example, raw cotton used and the quality of the bleached cotton required. A skilled person in the art will be able to determine the need of pretreatment steps to reduce in the following bleaching step the amounts of chemicals to attain the desired whiteness and quality.

It is preferred that after the pretreatment, acidic or basic, that the substrate is washed with clean water. The water is preferably demineralised or contains a small amount of sequestrant.

The pretreatment may be that of a basic or acidic pretreatment step. It is preferred that the pretreatment step is basic.

When particularly poor raw cotton batches are applied (both based on a low whiteness (below 12 Berger units) or appearance (many husks, fatty appearance), the skilled person would recognise the need to pretreat this cotton material using an acidic or alkaline pretreatment processes.

Scouring is accomplished by saturating the cotton fibre with a caustic soda (sodium hydroxide) solution. The alkali solution is allowed to remain on the fibre at elevated temperatures to speed chemical reactions. During this time the natural oils and waxes are saponified (converted into soaps), the plant matter is softened, pectins and other noncellulosic materials are suspended so they can be washed away. After a predetermined amount of time to allow for complete scouring, the alkali, saponified waxes and suspended materials are rinsed away with water.

The pretreatment may be basic or acidic as described below.

a) Basic Pretreatment

This treatment consists of pretreating the substrate with a basic aqueous solution. Preferably the aqueous solution is that of an alkali or alkaline earth metal hydroxide. Preferred hydroxides are those of sodium and potassium hydroxide; that of sodium hydroxide is most preferred.

Preferably the basic aqueous solution has a pH in the range from 9 to 13, preferably between 10 and 12. It is preferred that the basic pretreatment comprises a surfactant. In this regard, it is preferred that a surfactant is present in the range from 0.1 to 20 g/L, preferably 0.5 to 10 g/l, in the basic aqueous solution. It is preferred that the surfactant is a non-ionic surfactant and most preferably biodegradable.

The basic aqueous solution used in the pretreatment step may optionally comprise a sequestrant.

b) Acidic Pretreatment

This treatment consists of pretreating the substrate with an acidic aqueous solution. Preferably the acidic aqueous solution is that of sulphuric or hydrochloric acid. Preferably the acidic aqueous solution has a pH in the range from 2 to 6, preferably between 2 and 5. It is preferred that the acidic pretreatment comprises a surfactant.

In this regard, it is preferred that a surfactant is present in the range from 0.1 to 20 g/L, preferably 0.5 to 10 g/l, in the acidic aqueous solution. It is preferred that the surfactant is a non-ionic surfactant and most preferably biodegradable.

It is preferred that the acidic aqueous solution also comprises a transition metal sequestrant. The sequestrant may be that of an aminocarboxylate sequestrant, EDDS, one sold under the name Dequest™. Preferably the sequestrant used is an oxalate, preferably applied as oxalic acid. The sequestrant used in the acidic aqueous solution are preferably in the range between 0.5 and 5 g/l.

EXPERIMENTAL

Raw cotton with a Berger Whiteness value of 5.5+/−1.0 was treated as follows: 2 grams of the cotton was immersed into small vessels a 20 ml solution (cloth/liquor ratio of 1/10) containing 30 microM of $[Mn_2O_3(Me_3\text{-}TACN)_2]$ $(PF_6)_2.H_2O$, 2.3% $H_2O_2$ (equals to 6.66 ml (35%)/l; w/w with respect to cotton), 0.4 g/l H5-DTPA (ex Akzo-Nobel; trade name Dissolvine D50; purity is 50%), 2.25 g/l Na-borax (Merck; 99% di-Sodium tetraborate decahydrate (381.37 g/mol)); pH-value adjusted to desired level, 1 g/l Sandoclean PCJ (ex Clariant).

Similarly, experiments were done using carbonate buffer (5 g/l sodium carbonate; mw=106). The order of addition of the chemicals was: water-buffer-Sandoclean-DTPA-hydrogen peroxide-$[Mn_2O_3(Me_3\text{-}TACN)_2]$ $(PF_6)_2.H_2O$.

The mixtures was heated at 65° C. and continuously shaken. Each experiment was repeated 3 times. Afterwards the cotton swatches were rinsed with 2 to 3 litres of hot demineralised water (80° C.), then washed with copious amounts of demineralised water and then dried in a spin drier (3 minutes) and dried overnight under ambient conditions. The cloths were then measured using a Minolta spectrophotometer CM-3700d, using L, a, b values which are converted to Berger Whiteness values.

The levels of catalyst, borate or pH were adjusted to the desired levels in each experiment. Further experiments were conducted using carbonate buffer (5 g/l $Na_2CO_3$).

The values of the whiteness is expressed in Berger units. The formula of Berger whiteness is given below:

$$W_{berger}=Y+a\cdot Z-b\cdot X, \text{ where } a=3.448 \text{ and } b=3.904.$$

The values X, Y, Z are the coordinates of the achromatic point.

High whiteness was reached by first pre-treating the cotton at 60° C. for 30 min (cloth/liquor ratio of 1/10). Three different pre-treatment method was used as detailed below.

1. Pre-treatment with 1 g/l DTPA, 0.5 g/l Sandoclean PCJ and 3 g/l oxalic acid at a pH of 2.2 provides Wb 21.
2. Pre-treatment with 1 g/l DTPA, 0.5 g/l Sandoclean PCJ at a pH 11 provides Wb 25.
3. Pre-treatment with 0.5 g/l Sandoclean PCJ at a pH 11 provides Wb 25.

After pre-treatment the cotton was rinsed 4 times with demi-water and then spin dried for 3 minutes in spin-drier, thereafter the cloths are dried overnight at room temperature.

After pre-treatment the cotton swatches were rinsed with 2 to 3 litres of hot demineralised water (80° C.), then washed with copious amounts of demineralised water and then dried in a spin drier (3 minutes) and dried overnight under ambient conditions.

Experiment Set 1

Table 1 shows the bleach results obtained using pretreated cotton (pretreatment procedure: 60° C./30 min, pH 11, using 1 g/l DTPA, 0.5 g/l Sandoclean PCJ (ex Clariant)), which is then bleached for 60 minutes at 65° C. by using 0.2 g/l DTPA, 2 g/l Sandoclean PCJ (ex Clariant), 2.25 g/l Na-borax (pH variable), 2.3% $H_2O_2$ (w/w with respect to cotton) and 30 μM of $[Mn_2O_3(Me_3\text{-}TACN)\ 2]\ (PF_6)_2.H_2O$.

TABLE 1

Whiteness (Berger) results obtained using $[Mn_2O_3(Me_3\text{-}TACN)_2](PF_6)_2 \bullet H_2O$ in borate buffer with DTPA.

| pH | Wb | SD |
|---|---|---|
| 9 | 64.3 | 0.0 |
| 9.25 | 66.9 | 0.9 |
| 9.5 | 68.6 | 0.9 |
| 9.75 | 69.3 | 0.3 |
| 10 | 69.3 | 0.6 |
| 10.25 | 68.9 | 1.6 |
| 10.5 | 67.2 | 1.6 |

The results shown in the Table 1 indicate that the optimum pH range using borate buffer will be obtained between pH 9.5 and 10.

SD=Standard Deviation

Experiment Set 2

Table 2: shows the bleach results obtained using untreated cotton (whiteness 5 Berger) which was bleached for 60 minutes at 65° C. by using 0.2 g/l DTPA, 1 g/l Sandoclean PCJ (ex Clariant), 5 g/l Na-carbonate (pH variable), 2.3% $H_2O_2$ (w/w with respect to cotton) and 20 μM of $[Mn_2O_3(Me_3\text{-}TACN)\ 2]\ (PF_6)_2.H_2O$

TABLE 2

Whiteness (Berger) results obtained using $[Mn_2O_3(Me_3\text{-}TACN)_2](PF_6)_2 \bullet H_2O$ in carbonate buffer with DTPA

| Initial pH | Wb | SD |
|---|---|---|
| 7.07 | 52.2 | 0.7 |
| 7.47 | 52.4 | 0.1 |
| 7.95 | 54.3 | 0.5 |
| 8.5 | 54.4 | 0.7 |
| 8.96 | 54.4 | 0.1 |
| 9.53 | 52.1 | 1.0 |
| 9.76 | 48.1 | 1.8 |
| 10.06 | 47.3 | 0.4 |
| 10.27 | 47.1 | 0.5 |
| 10.56 | 47.3 | 0.2 |
| 10.72 | 45.5 | 0.1 |
| 10.98 | 46.0 | 0.6 |
| 11.55 | 39.3 | 0.4 |

The results shown in the table 2 indicate that the optimum pH range using carbonate buffer will be obtained between pH 8 and 9.

Experiment Set 3

Table 3 shows the bleach results obtained using pretreated cotton (pretreatment procedure: 60° C./30 min, pH 11, using 1 g/l DTPA, 0.5 g/l Sandoclean PCJ (ex Clariant)), which is then bleached for 60 minutes at 65° C. by using 0.2 g/l of each sequestrant, 2 g/l Sandoclean, 4.7 g/l Na-borax (pH 9.75), 2.3% $H_2O_2$ (w/w with respect to cotton) and 30 μM of $[Mn_2O_3(Me_3\text{-}TACN)_2]\ (PF_6)_2.H_2O$

TABLE 3

Whiteness (Berger) results obtained using $[Mn_2O_3(Me_3\text{-}TACN)_2](PF_6)_2 \bullet H_2O$ in borate buffer with different sequestrants.

| Sequestrant | Wb | SD |
|---|---|---|
| EDDS | 45.5 | 0.5 |
| Dequest 2047 | 50.9 | 0.1 |
| Dequest 2066 | 57.8 | 0.4 |
| MgSO4 + DTPA | 65.8 | 0.2 |
| DTPA | 67.5 | 1.0 |

The results shown in the Table 3 show that the best sequestrant identified is DTPA.

Experiment Set 4

Table 4 shows the bleach results obtained using untreated cotton (whiteness 5 Berger) which was bleached for 60 minutes at 70° C. by using 0, 0.1 or 0.2 g/l DTPA, 1 g/l Sandoclean PCJ (Clariant), 4.7 g/l Na-borax (pH 9.75 and 10.0), 2.3% $H_2O_2$ (w/w with respect to cotton) and 20 μM of $[Mn_2O_3(Me_3\text{-}TACN)_2]\ (PF_6)_2.H_2O$

TABLE 4

Whiteness (Berger) results obtained using $[Mn_2O_3(Me_3\text{-}TACN)_2](PF_6)_2 \bullet H_2O$ in borate buffer with 0, 0.1 or 0.2 g/l DPTA.

| | pH 9.75 | | pH 10 | |
|---|---|---|---|---|
| T 70° C. | WB | SD | WB | SD |
| without DTPA | 42.8 | 0.8 | | |
| 0.1 g/l DTPA | 54.0 | 0.9 | 48.6 | 1.4 |
| 0.2 g/l DTPA | 55.0 | | 54.1 | 1.0 |

The results shown in the Table 4 show that the presence of already low levels of DTPA improves the bleaching performance as compared to the reference that does not contain DPTA.

We claim:

1. A method for industrial bleaching of a substrate selected from textiles, raw cotton, or wood pulp, the method comprising subjecting the substrate to an aqueous medium, the aqueous medium comprising:

from 0.1 to 100 micromolar of a preformed transition metal catalyst salt;

from 0.01 to 10 g/l of an aminocarboxylate sequestrant or alkali/alkaline metal salt thereof;

from 5 to 1500 mM hydrogen peroxide;

wherein the aqueous medium is buffered with a buffer selected from the group consisting of a carbonate buffer wherein the aqueous medium has a pH in the range from 7.5 to 9.5 and a borate buffer wherein the aqueous medium has a pH in the range from 9 to 10.3; and wherein the preformed transition metal catalyst salt is a mononuclear or dinuclear complex of a Mn II-V transition metal catalyst, and the preformed transition metal catalyst salt comprises a ligand of formula (I):

(I)

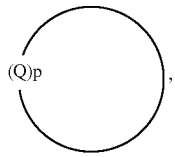

wherein:

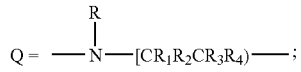

p is 3;

R is independently selected from the group consisting of: hydrogen, C1-C6-alkyl, $CH_2CH_2OH$, $CH_2COOH$, and pyridin-2-ylmethyl, or one of R is linked to the N of another Q via an ethylene bridge; and $R_1$, $R_2$, $R_3$, and $R_4$ are independently selected from the group consisting of: H, C1-C4-alkyl, and C1-C4-alkyl-hydroxy.

2. The method according to claim 1, wherein R is independently selected from the group consisting of: hydrogen, $CH_3$, $C_2H_5$, $CH_2CH_2OH$ and $CH_2COOH$.

3. The method according to claim 1, wherein R, $R_1$, $R_2$, $R_3$, and $R_4$ are independently selected from: H and Me.

4. The method according to claim 1, wherein the ligand is 1,4,7-Trimethyl-1,4,7-triazacyclononane (Me3-TACN).

5. The method according to claim 1, wherein the preformed transition metal catalyst salt has a water solubility of at least 50 g/l at 20° C.

6. The method according to claim 5, wherein the salt is that selected from the group consisting of chloride, acetate, sulphate, and nitrate.

7. The method according to claim 1, wherein the aminocarboxylate sequestrant is selected from the group consisting of: ethylenediaminetetraacetic acid (EDTA), N-hydroxyethylenediaminetetraacetic acid (HEDTA), nitrilotriacetic acid (NTA), N-hydroxyethylaminodiacetic acid, diethylenetriaminepentaacetic acid (DTPA), methylglycinediacetic acid (MGDA), and alanine-N,N-diacetic acid.

8. The method according to claim 1, wherein the aqueous medium comprises between 0.1 to 20 g/L of non-ionic surfactant.

9. The method according to claim 1, wherein the substrate has been subjected to a pretreatment step selected from the group consisting of:

a) treatment with a basic aqueous solution having a pH in the range from 9 to 13 and b) treatment with an acidic aqueous solution having a pH in the range from 2 to 6.

10. The method according to claim 9, wherein the basic aqueous solution or the acidic aqueous solution comprises a surfactant, the surfactant present in the range from 0.1 to 20 g/L.

11. The method according to claim 10, wherein the surfactant is a non-ionic surfactant.

12. The method according to claim 1, wherein the method is a continuous process and the concentration of hydrogen peroxide is in the range from 100 mM to 1.5 M.

13. A method for industrial bleaching of a substrate selected from textiles, raw cotton, or wood pulp, the method comprising subjecting the substrate to an aqueous medium, the aqueous medium comprising:

from 0.1 to 100 micromolar of a preformed transition metal catalyst salt;

from 0.01 to 10 g/l of an aminocarboxylate sequestrant or alkali/alkaline metal salt thereof;

from 5 to 1500 mM hydrogen peroxide;

wherein the aqueous medium is buffered with a buffer selected from the group consisting of a carbonate buffer wherein the aqueous medium has a pH in the range from 7.5 to 9.5 and a borate buffer wherein the aqueous medium has a pH in the range from 9 to 10.3; and wherein the preformed transition metal catalyst salt is a mononuclear or dinuclear complex of a Mn II-V transition metal catalyst; and the preformed transition metal catalyst salt comprises a ligand that is 1,2,-bis-(4,7,-dimethyl-1,4,7,-triazacyclonon-1-yl)-ethane (Me-4-DTNE).

* * * * *

UNITED STATES PATENT AND TRADEMARK OFFICE

CERTIFICATE OF CORRECTION

PATENT NO. : 7,972,386 B2
APPLICATION NO. : 12/083456
DATED : July 5, 2011
INVENTOR(S) : Joaquim Manuel Henriques de Almeida et al.

It is certified that error appears in the above-identified patent and that said Letters Patent is hereby corrected as shown below:

In the Specification

In Column 7, Line 9 (Approx.), change "-TACN) 2]" to -- -TACN)$_2$]--.

In Column 7, Line 36 (Approx.), change "-TACN) 2]" to -- -TACN)$_2$]--.

In the Claims

In Column 9, Line 36, in Claim 6, after "salt is" delete "that".

In Column 10, Line 40, in Claim 13, change "(Me-4-DTNE)." to --(Me4-DTNE).--.

Signed and Sealed this
Twenty-fourth Day of June, 2014

Michelle K. Lee

Michelle K. Lee
*Deputy Director of the United States Patent and Trademark Office*